US005765873A

United States Patent [19]

Chen

[11] Patent Number: 5,765,873

[45] Date of Patent: Jun. 16, 1998

[54] DOCUMENT FOLDER ASSEMBLY

[76] Inventor: Cheng-Sung Chen, No. 380, Chung-Hua Rd., Tou-Liu City, Yun-Lin Hsien, Taiwan

[21] Appl. No.: 877,085

[22] Filed: Jun. 17, 1997

[51] Int. Cl.[6] ..... B42D 3/00

[52] U.S. Cl. ..... 281/45; 281/28; 402/60

[58] Field of Search ..... 281/15.1, 21.1, 281/28, 45, 42, 46; 402/60, 80 R; 229/67.1, 67.4

[56] References Cited

U.S. PATENT DOCUMENTS

| | | | |
|---|---|---|---|
| 4,904,104 | 2/1990 | Gloeckle | 281/45 X |
| 5,226,676 | 7/1993 | Su | 281/45 |
| 5,285,952 | 2/1994 | Ho | 281/45 X |
| 5,413,430 | 5/1995 | Schrem et al. | 281/45 X |

*Primary Examiner*—Willmon Fridie, Jr.
*Attorney, Agent, or Firm*—Foley & Lardner

[57] ABSTRACT

A document folder assembly includes a clip member with front and rear clip portions, and a connecting portion interconnecting adjacent first edge portions of the front and rear clip portions. One of the front and rear clip portions has an inner side formed with a hook projection which is spaced from the first edge portion by a first distance. A folder unit has front and back sheet portions adapted to receive documents therebetween, and a hinge portion for hinging together adjacent edge sections of the front and back sheet portions. The hinge portion is clamped in the clip member for retaining the documents in the folder unit. One of the front and back sheet portions is provided with an outwardly projecting retaining piece which has a free retaining edge spaced from the adjacent edge sections by a second distance smaller than the first distance. The hook projection engages the retaining edge when the clip member is provided on the folder unit and is moved in a direction transverse to the adjacent edge sections to permit removal of the documents in the folder unit. The clip member is movable along length of the hinge portion for release from the folder unit.

7 Claims, 3 Drawing Sheets

DOCUMENT FOLDER ASSEMBLY

BACKGROUND OF THE INVENTION

1 . Field of the Invention

The present invention relates to a document folder assembly, more particularly to a document folder assembly which is relatively convenient to use, which facilitates insertion and removal of documents, and which permits binding of the documents retained therein in a standard ring binder without the need for punching binding holes in the documents.

2 . Description of the Related Art

FIG. 1 shows a conventional document folder assembly which includes a clip member 12 and a folder unit 11. The folder unit 11 includes front and back sheet portions and a hinge portion 111 interconnecting adjacent edges of the front and back sheet portions. The hinge portion 111 is formed with a retaining projection 112 which protrudes forwardly therefrom. The clip member 12 includes front and rear clip portions 120*a*, 120*b*. The front clip portion 120*a* is formed with a slot 121. The hinge portion 111 of the folder unit 11 is clamped between the front and rear clip portions 120*a*, 120*b* so that the retaining projection 112 extends into the slot 121 and is movable within the slot 121 when the clip member 12 moves along a direction transverse to the hinge portion 111. The retaining projection 112 engages a periphery of the slot 121 to prevent release of the clip member 12 from the folder unit 11 when the clip member 12 is moved along the direction transverse to the hinge portion 111 away from the folder unit 11 to permit removal of the documents received in the folder unit 11.

As shown, the retaining projection 112 and the slot 121 in the clip member 12 cooperatively prevent removal of the clip member 12 from the folder unit 11 when the clip member 12 is moved transversely away from the folder unit 11 for releasing the documents in the folder unit 11. Since a space is formed between the front and rear clip portions 120*a*, 120*b* of the clip member 12, the retaining projection 112 must have a height sufficient to project out of the slot 121 in the front clip portion 120*a*. This, however, results in difficulties when the clip member 12 is assembled to or disassembled from the folder unit 11 since a relatively large force should be applied to the clip member so as to force the front and rear clip portions 120*a*, 120*b* away from each other. Inconvenience thus results. Moreover, the documents retained in a plurality of the aforesaid document folder assemblies cannot be conveniently bound together into a volume to facilitate reading of the documents. The conventional document folder assembly is thus not satisfactory.

SUMMARY OF THE INVENTION

The main object of the present invention is to provide a document folder assembly which is relatively convenient to use, and which has a clip member that can be easily assembled to or disassembled from a folder unit.

Another object of the present invention is to provide a document folder assembly which facilitates binding of the documents received therein in a standard ring binder without the need for punching binding holes in the documents.

Accordingly, the document folder assembly of the present invention includes a clip member and a folder unit. The clip member has a front clip portion, a rear clip portion, and a connecting portion interconnecting adjacent first edge portions of the front and rear clip portions. The front and rear clip portions cooperatively confine a clamping space. One of the front and rear clip portions has an inner side facing the clamping space and formed with a hook projection at a second edge portion opposite to the first edge portion thereof. The hook projection is spaced from the first edge portion by a first distance. The folder unit has a front sheet portion, a back sheet portion, and a hinge portion for hinging together adjacent edge sections of the front and back sheet portions. The front and back sheet portions are adapted to receive documents therebetween. The hinge portion is clamped in the clamping space of the clip member for retaining the documents in the folder unit. One of the front and back sheet portions is provided with an outwardly projecting retaining piece which has a free retaining edge spaced from the adjacent edge sections by a second distance that is smaller than the first distance. The hook projection of the clip member is registered with the retaining piece of the folder unit when the clip member is provided on the folder unit so as to permit engagement of the hook projection with the retaining edge of the retaining piece when the clip member is moved in a direction transverse to the adjacent edge sections of the front and back sheet portions to permit removal of the documents in the folder unit. The retaining piece has a rigidity sufficient to prevent release of the clip member from the folder unit in the transverse direction upon engagement with the hook projection. The clip member is movable along length of the hinge portion when the retaining piece engages the hook projection to result in relative movement between the hook projection and the retaining piece so as to release the clip member from the folder unit.

In a preferred embodiment, the hinge portion of the folder unit is formed with a binding extension which has binding holes that are adapted for mounting the document folder assembly on a standard ring binder.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
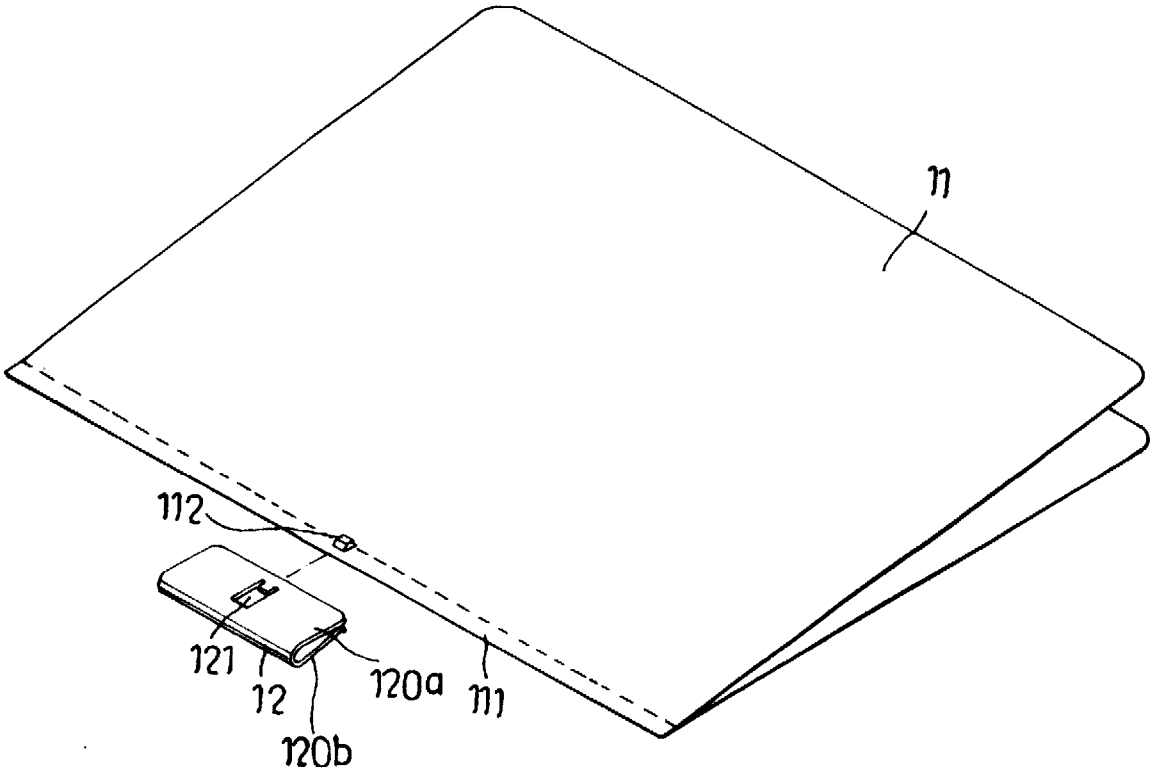
FIG. 1 PRIOR ART
FIG. 1 is an exploded perspective view illustrating a conventional document folder assembly.
Figure 2:
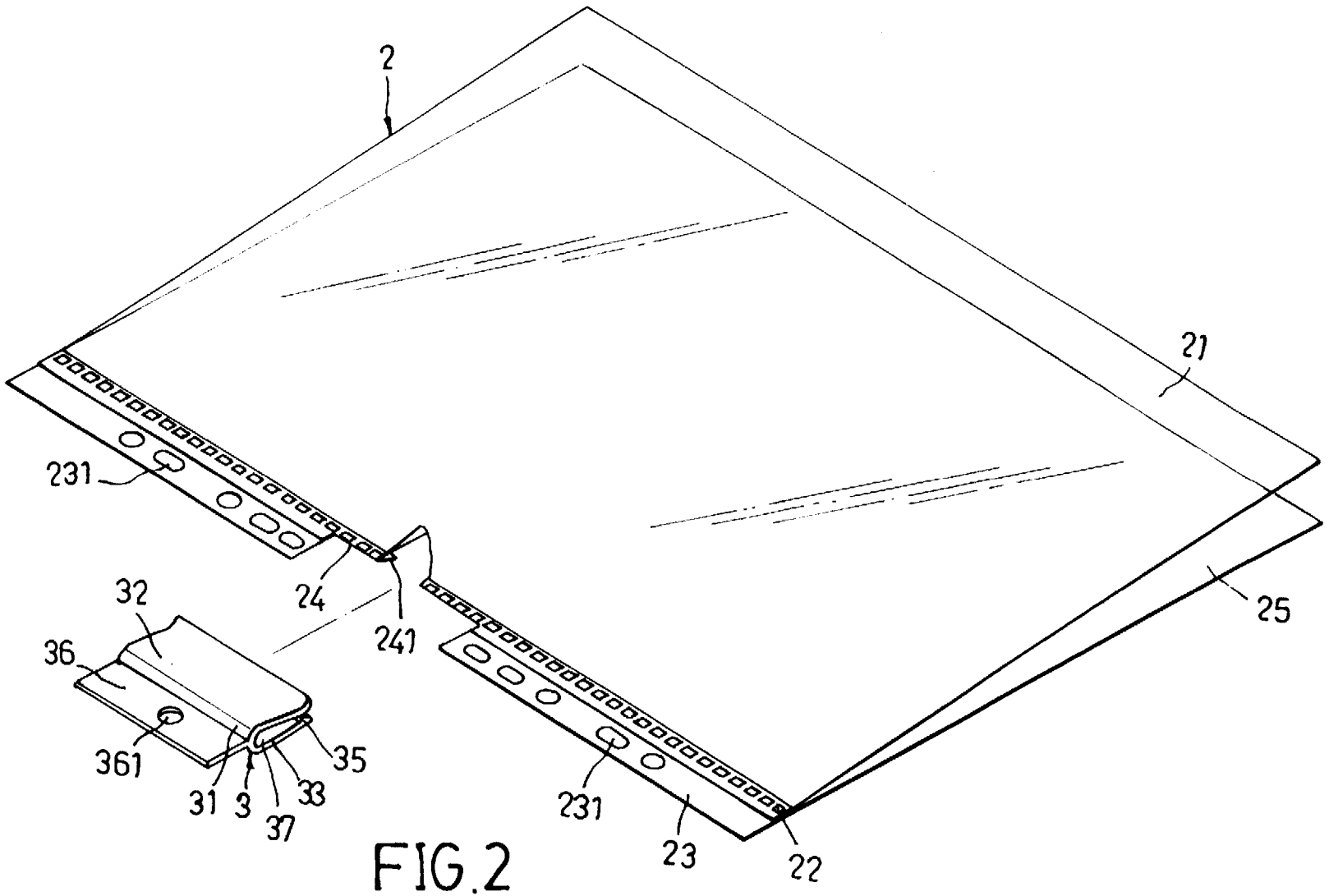
FIG. 2 is an exploded perspective view of a document folder assembly according to a preferred embodiment of the present invention.
Figure 3:
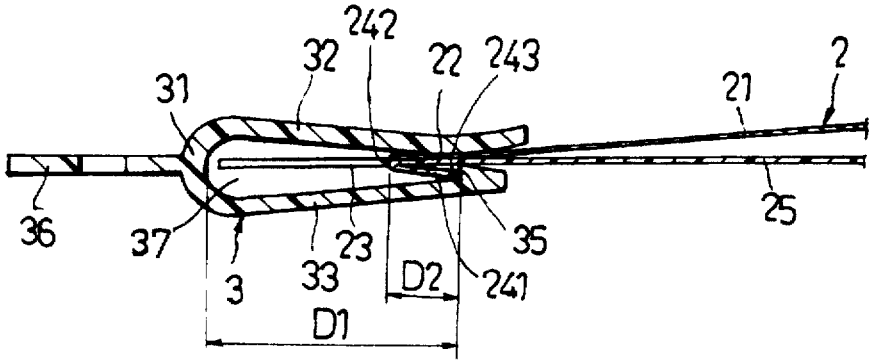
FIGS. 3 and 4 are cross-sectional views of the document folder assembly of the preferred embodiment when in use.

Referring to FIGS. 2 and 3, the document folder assembly according to the preferred embodiment of the present invention is shown to include a folder unit 2 and a clip member 3.

The folder unit 2 has a front sheet portion 21, a back sheet portion 25, and a hinge portion 22 for hinging together adjacent edge sections of the front and back sheet portions 21, 25. In this embodiment, the front and back sheet portions 21, 25 are both made of heat-sealable plastic sheet material and are hinged to one another by heat-sealing. The front and back sheet portions 21, 25 are adapted to receive documents therebetween. The hinge portion 22 of the folder unit 2 is formed with a first binding extension 23 which has a plurality of aligned first binding holes 231 that are adapted for mounting the document folder assembly on a standard ring binder (not shown). The first binding holes 231 may be circular or oval in shape or may include alternately arranged circular-shaped and oval-shaped ones as in the present embodiment. The first binding extension 23 has a notch 24 which divides the first binding extension 23 into two spaced sections. The back sheet portion 25 is provided with an outwardly projecting retaining piece 241 which is formed as an elongated strip folded from the back sheet portion 25 and which is provided on a rear side of the back sheet portion 25 adjacent to the notch 24. The retaining piece 241 has a mounting edge 242 joined to the adjacent edge sections of the front and back sheet portions 21, 25 and a free retaining edge 243 that is opposite to the mounting edge 242.

The clip member 3 has a front clip portion 32, a rear clip portion 33, and a connecting portion 31 interconnecting adjacent first edge portions of the front and rear clip portions 32, 33. The front and rear clip portions 32, 33 cooperatively confine a clamping space 37 for clamping the folder unit 2 at the hinge portion 22. The connecting portion 31 of the clip member 3 is formed with a second binding extension 36 which has a second binding hole 361 aligned with the first binding holes 231 and adapted to be mounted on the standard ring binder. The rear clip portion 33 has an inner side facing the clamping space 37 and formed integrally with a hook projection 35 at a second edge portion opposite to the first edge portion and away from the connecting portion 31.

Figure 4:
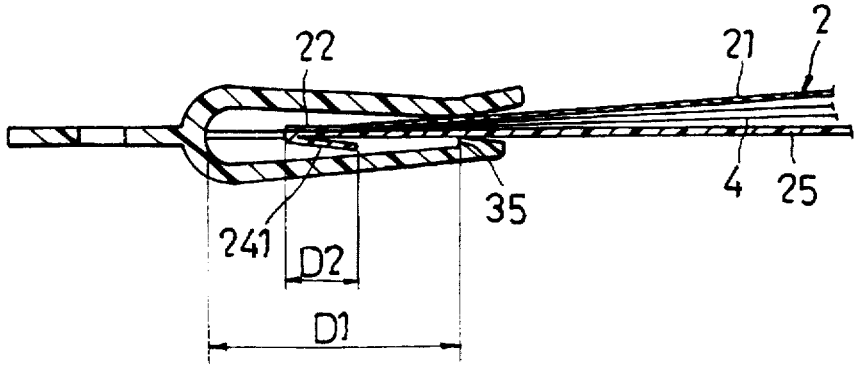

Referring to FIGS. 3 and 4, the hook projection 35 of the rear clip portion 33 is spaced from the first edge portion of the rear clip portion 33 by a first distance (D1). The free retaining edge 243 of the retaining piece 241 is spaced from the adjacent edge sections of the front and back sheet portions 21, 25 by a second distance (D2) smaller than the first distance (D1). When the clip member 3 is provided on the folder unit 2, the hook projection 35 is registered with the retaining piece 241 of the folder unit 2. Therefore, when the clip member 3 is moved in a direction transverse to the adjacent edge sections of the front and back sheet portions 21, 25, i.e., from a position as shown in FIG. 4 to a position as shown in FIG. 3, to permit removal of the documents 4 in the folder unit 2, the hook projection 35 can engage the retaining edge 243 of the retaining piece 241. The retaining piece 241 has a rigidity sufficient to prevent release of the clip member 3 from the folder unit 2 in the transverse direction upon engagement with the hook projection 35.

Referring to FIGS. 2 and 3, to assemble the document folder assembly of the present embodiment, the clip member 3 is moved toward the folder unit 2 along the direction transverse to the hinge portion 22 of the folder unit 2. The notch 24 enables the clip member 3 to clamp effectively the hinge portion 22 of the folder unit 2. The hook projection 35 of the clip member 3 slides over the retaining piece 241 when the clip member 3 is moved in the transverse direction during assembly. Alternatively, the clip member 3 can be moved toward the folder unit 2 to clamp a part of the hinge portion adjacent to one of the sections of the first binding extension 23 and is then moved along the length of the hinge portion 22 toward the notch 24 until the clip member 3 is located in the notch 24 and the retaining piece 241 of the folder unit 2 is registered with the hook projection 35 of the clip member 3 and engages the same. To disassemble the document folder assembly, the clip member 3 is moved along the length of the hinge portion 22 to result in relative movement between the hook projection 35 and the retaining piece 241 to disengage the hook projection 35 from the retaining piece 241. The clip member 3 can thus be pulled outwardly along the direction transverse to the hinge portion 22 of the folder unit for release from the folder unit 2.

In use, the clip member 3 is moved outwardly along the direction transverse to the hinge portion 22 of the folder unit 2, i.e., from the position shown in FIG. 4 to the position shown in FIG. 3, so that the hook projection 35 engages the retaining edge 243 of the retaining piece 241. The documents to be held in the document folder assembly are disposed between the front and back sheet portions 21, 25 of the folder unit 2 so that an edge portion of the documents extends toward the hinge portion 22. The clip member 3 is then moved to clamp the hinge portion 22 and retain the documents 4 in the folder unit 2, as shown in FIG. 4. The aforementioned procedures are repeated when the documents are removed from the document folder assembly or when additional documents are to be received in the document folder assembly. The document folder assembly with the first and second binding extensions 23, 36 can be mounted on a standard ring binder to facilitate reading of the documents.

Note that the retaining piece may be alternatively provided on a front side of the front sheet. In this situation, the hook projection is formed on an inner side of the front clip portion.

It has thus been shown that the hook projection 35 of the clip member 3 is capable of sliding over the retaining piece 241 to compress the same when the clip member 3 is moved inwardly along the direction transverse to the hinge portion 22 of the folder unit 2 to clamp the hinge portion 22 of the folder unit 2. In addition, the clip member 3 is movable along the length of the hinge portion 22 when the retaining piece 241 engages the hook projection 35 to result in relative movement between the hook projection 35 and the retaining piece 241 so as to release the clip member 3 from the folder unit 2. Assembly and disassembly of the document folder assembly is therefore relatively convenient to conduct. Moreover, binding extensions 23, 36 are provided on the folder unit 2 and the clip member 3 for binding the documents into a volume in a standard ring binder without the need for punching binding holes in the documents. The objects of the invention are thus achieved.

With this invention thus explained, it is apparent that numerous modifications and variations can be made without departing from the scope and spirit of this invention. It is therefore intended that this invention be limited only as indicated in the appended claims.

I claim:

1. A document folder assembly comprising:

a clip member having a front clip portion, a rear clip portion, and a connecting portion interconnecting adjacent first edge portions of said front and rear clip portions, said front and rear clip portions cooperatively confining a clamping space, one of said front and rear clip portions having an inner side facing said clamping space and formed with a hook projection at a second edge portion opposite to said first edge portion thereof, said hook projection being spaced from said first edge portion by a first distance; and a folder unit which has a front sheet portion, a back sheet portion, and a hinge portion for hinging together adjacent edge sections of said front and back sheet portions, said front and back sheet portions being adapted to receive documents therebetween, said hinge portion being clamped in said clamping space of said clip member for retaining the documents in said folder unit, one of said front and back sheet portions being provided with an outwardly projecting retaining piece which has a free retaining edge spaced from said adjacent edge sections by a second distance that is smaller than said first distance, said hook projection of said clip member being registered with said retaining piece of said folder unit when said clip member is provided on said folder unit so as to permit engagement of said hook projection with said retaining edge of said retaining piece when said clip member is moved in a direction transverse to said adjacent edge sections of said front and back sheet portions to permit removal of the documents in said folder unit, said retaining piece having a rigidity sufficient to prevent release of said clip member from said folder unit in the transverse direction upon engagement with said hook projection, said clip member being movable along length of said hinge portion when said retaining piece engages said hook projection to result in relative movement between said hook projection and said retaining piece so as to release said clip member from said folder unit.

2. The document folder assembly according to claim 1, wherein said retaining piece further has a mounting edge which is opposite to said retaining edge and which is joined to said adjacent edge sections of said front and back sheet portions.

3. The document folder assembly according to claim 2, wherein said retaining piece is formed as an elongated strip.

4. The document folder assembly according to claim 1, wherein said hinge portion of said folder unit is formed with a first binding extension which has first binding holes that are adapted for mounting said document folder assembly on a standard ring binder.

5. The document folder assembly according to claim 4, wherein said first binding extension has a notch to enable said clip member to clamp said hinge portion of said folder unit, said retaining piece being located adjacent to said notch.

6. The document folder assembly according to claim 5, wherein said clip member is formed with a second binding extension which has a second binding hole adapted for mounting said clip member on the standard ring binder.

7. The document folder assembly according to claim 1, wherein said retaining piece is provided on a rear side of said back sheet portion, said hook projection being formed on said rear clip portion.

* * * * *